United States Patent [19]

Iwai et al.

[11] Patent Number: 4,566,415

[45] Date of Patent: Jan. 28, 1986

[54] SPEED CONTROLLER FOR MARINE PROPULSION DEVICE

[75] Inventors: Tomio Iwai, Hamamatsu; Katsumi Torigai, Shizuoka, both of Japan

[73] Assignee: Sanshin Kogyo Kabushiki Kaisha, Hamamatsu, Japan

[21] Appl. No.: 565,239

[22] Filed: Dec. 27, 1983

[30] Foreign Application Priority Data

Dec. 28, 1982 [JP] Japan ..... 57-227558

[51] Int. Cl.[4] ..... F02D 31/00

[52] U.S. Cl. ..... 123/361; 123/400; 123/413

[58] Field of Search ..... 123/342, 319, 361, 376, 123/398, 400, 403, 413

[56] References Cited

U.S. PATENT DOCUMENTS 3,769,949 11/1973 Elingsen ..... 123/413
4,304,202 12/1981 Schofield ..... 123/376
4,455,978 6/1984 Atago et al. ..... 123/361
4,462,357 7/1984 Lockhart ..... 123/361

FOREIGN PATENT DOCUMENTS 57-24430 2/1982 Japan ..... 123/319

*Primary Examiner*—William A. Cuchlinski, Jr.
*Attorney, Agent, or Firm*—Ernest A. Beutler

[57] ABSTRACT

Several embodiments of engine speed control mechanisms that permit the running speed of an engine to be maintained at a predetermined value. The mechanical components of the system include a linkage system that connects an operator position throttle control with the throttle valves of the engine and that incorporates a lost motion connection so that the throttle valves may be positioned independently of the operator throttle control to maintain the speed control. In one embodiment of the invention, the throttle and speed control mechanism is mounted on the engine while in another embodiment, these components are mounted remotely from the engine. In one embodiment of the invention, a control circuit is provided that prevents hunting.

16 Claims, 13 Drawing Figures

SPEED CONTROLLER FOR MARINE PROPULSION DEVICE

BACKGROUND OF THE INVENTION

This invention relates to a speed controller for a marine propulsion device and more particularly to an improved control arrangement for maintaining the speed of an internal combustion engine within a preset range.

In many devices powered by internal combustion engines, the operator has a speed control which he sets so as to select the running speed of the engine. However, the actual running speed of the engine can vary considerably from the preset speed due to variations in running conditions and other factors. For example, when considering a watercraft propelled by an internal combustion engine, the operator normally sets the engine running speed with a throttle or throttle lever of some type. However, even though the operator selects an appropriate speed for certain conditions, the actual speed of the engine may vary considerably due to a variety of factors. For example, as the propeller becomes worn, the speed of the engine may increase above that desired by the operator and, in fact, above that which is safe for engine operation. Also, a variety of transient conditions can cause the engine to speed up or slow down from the value set by the operator. Therefore, it is necessary for the operator to keep a vigilant eye on the tachometer so as to prevent overspeeding of the engine and resulting damage.

It is, therefore, a principal object of this invention to provide an improved speed control mechanism for an internal combustion engine.

It is another object of this invention to provide a speed control mechanism for a marine propulsion device wherein the running speed of the engine is maintained at a substantially constant value regardless of variations in external conditions.

It is a further object of this invention to provide a speed control for a marine propulsion device wherein the speed control does not interfere with the normal throttle operation of the engine.

In conjunction with a speed control constructed in accordance with an embodiment of the invention, a device is provided for sensing differences between desired engine speed and actual running speed. This sensing device controls a throttle mechanism so as to maintain the engine running speed at the preset speed. Although such an arrangement is particularly advantageous, a device that merely senses speed differences and compensates for them may cause excessive hunting of the throttle position, may be subject to undue wear and may, under some conditions, adversely affect the performance under acceleration.

It is, therefore, a still further object of this invention to provide an improved control for a speed control device that minimizes undesirable hunting and the like.

SUMMARY OF THE INVENTION

A first feature of this invention is adapted to be embodied in a speed control mechanism for an internal combustion engine having an engine speed control for controlling the operational speed of the engine and movable through a range of positions. An operator controlled speed selector is movable through a range of positions and means interrelate the speed selector and the engine speed control for positioning the engine speed control in response to an operator input to the speed selector for selecting the running speed of the engine. The interconnecting means includes means for permitting the engine speed control to move independently of the speed selector. Means measure the actual speed of the engine and means are provided for moving the engine speed control independently of the speed selector for varying the actual running speed of the engine if the measured speed is not of a predetermined value.

Another feature of this invention is also adapted to be embodied in an engine speed control. In accordance with this feature, means are provided for sensing actual engine speed. Comparator means provides an output signal for increasing engine speed when the actual engine speed falls below a predetermined, minimum desirable speed and for providing an output signal for decreasing engine speed when actual engine speed exceeds a predetermined maximum desirable level. The minimum and maximum desirable engine speeds define a range that includes the optimum desired engine speed.

DETAILED DESCRIPTION OF THE PREFERRED EMBODIMENTS

Embodiment of FIGS. 1 Through 5

Figure 1:
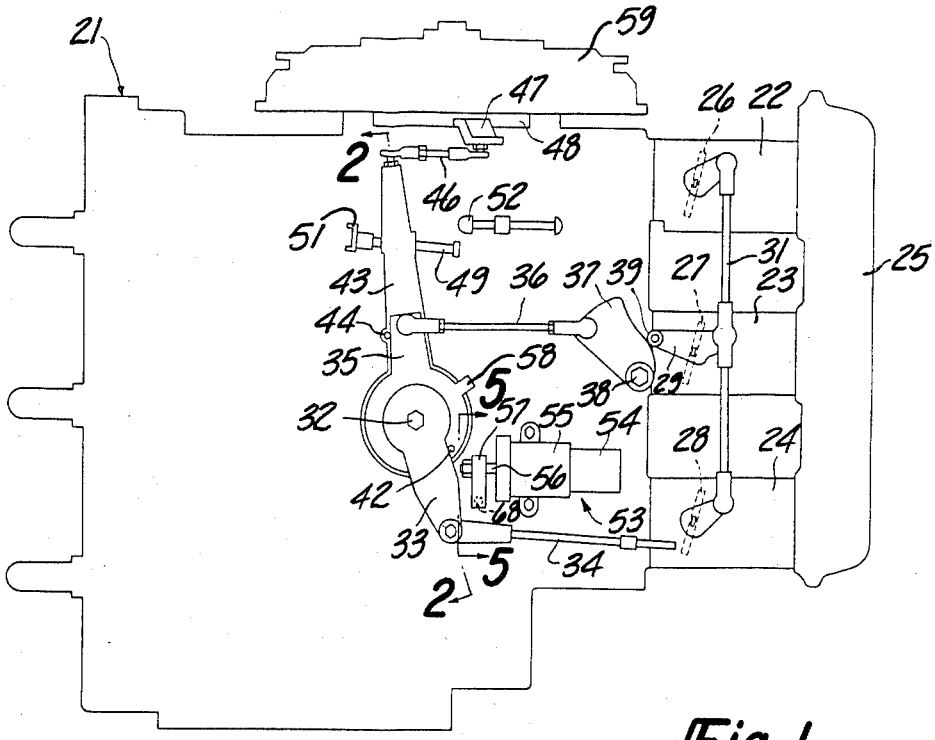
FIG. 1 is a side elevational view of a portion of an outboard motor having a speed control constructed in accordance with a first embodiment of the invention and showing the engine in an idling condition.

FIGS. 1 through 5 show the application of an embodiment of the invention to the engine of an outboard motor, indicated generally by the reference numeral 21. The engine 21 is of the multiple cylinder type with its crankshaft disposed so that its rotational axis extends in a generally vertical direction. In the illustrated embodiment, the engine 21 is of the two cycle type and includes a plurality of carburetors 22, 23 and 24, each of which serves a respective cylinder or pairs of cylinders of the engine 21. An air intake device 25 is provided for silencing intake air delivered to the induction inlets of the carburetors 22, 23 and 24. The carburetors 22, 23 and 24 each have respective throttle valves 26, 27 and 28 that are rotatably journalled in their induction passages in a known manner. A throttle lever 29 is affixed to the throttle valve shaft of the throttle valve 27 of the center carburetor 23. The lever 29 is affixed to corresponding levers carried by the shafts of the throttle valves 26 and 28 by means of a throttle link 31 so that the throttle valves 26, 27 and 28 will all be operated in unison, by a structure now to be described.

A bolt 32 is affixed to the side of the engine 21 and journals a throttle lever 33. The throttle lever 33 is connected to a remotely positioned operator control speed selector, such as a throttle lever, by means of a wire transmitter 34. The application of a force to the wire transmitter 34 will effect rotation of the throttle lever 33 from the idle position shown in FIG. 1 to a throttle opening position, as will become apparent.

A throttle control lever 35 is also journalled upon the bolt 32 in concentric relationship to the throttle lever 33. The throttle control lever 35 is connected by means of a link 36 to a throttle control cam 37. The cam 37 is rotatably journalled on the engine 21 by means of a pivot shaft 38. The cam 37 engages a roller follower 39 carried by the throttle lever 28 so as to convert rotary movement of the throttle cam 37 into opening and closing movement of the throttle valves 26, 27 and 28. The throttle valves 26, 27 and 28 are normally biased to their idle position by means of a return spring or return springs (not shown).

A torsional spring 41 is contained within a cylindrical recess of the throttle control lever 35 and has one of its ends affixed to this lever and its opposite end non-rotatably affixed to the throttle lever 33. The spring 41 exerts a torsional force on the throttle control lever 35 so as to urge a pin 42 carried by the throttle control lever 35 into engagement with the throttle lever 33 so that the throttle control lever 35 will be urged toward an angular position corresponding to the angular position of the throttle lever 33. That is, as the throttle lever 33 is rotated from its idle position, as shown in FIG. 1, to a throttle opening position in a clockwise direction, the torsional spring 41 will cause the throttle control lever 35 to follow the clockwise movement of the throttle lever 33. As will become apparent, however, this arrangement is such that there is a lost motion connection between the levers 33 and 35 so that the lever 35 can be rotated independently of the position of the lever 33 within a certain range.

A spark contol lever 43 is also journalled upon the bolt 32. The spark control lever 43 carries a pin 44 that is urged into contact with the throttle control lever 35 by means of a torsional spring 45 that acts between the levers 35 and 43. Hence, as the throttle control lever 35 rotates in a clockwise direction, the spring 45 will urge the pin 44 into engagement with the throttle control lever 35 so that the spark control lever 43 also rotates in a clockwise ddirection.

A spark control link 46 is pivotally connected at one end to the outer end of the spark control lever 43. The opposite end of the spark control link 46 is pivotally connected to a tang 47 of a spark advance plate 48 that is mounted in proximity to the upper end of the crankshaft and which is operative to control the spark timing, in a known manner.

The spark control lever 45 carries a first stop member 49 that is adapted to engage a stop plate 51 affixed to the side of the motor 21 so as to set the degree of spark advance when the engine is in an idle condition.

A maximum spark advance control stop 52 is carried by the engine 21 on the opposite side of the stop plate 51. The maximum spark advance stop 52 is adapted to engage the spark control lever 43 when the throttle valves 26, 27 and 28 are open to a predetermined degree (FIG. 3) so as to limit the degree of maximum spark advance. Upon continued opening of the throttle valves 26, 27 and 28 by rotation of the throttle control lever 35, the spark control lever 44 will be held against rotation by the stop 52 and the torsional spring 45 will be loaded so that the throttle control lever 35 may continue to rotate in a clockwise direction while the spark control lever 43 is held against further movement.

A speed control mechanism, indicated generally by the reference numeral 53 is provided for controlling the position of the throttle control lever 35 to some degree independently of the position of the throttle lever 33. The speed control mechanism 53 includes a reversible electric motor 54 which drives a step down transmission 55 and which is mounted on the side of the engine 21. The transmission 55 has an output shaft 56 to which a cam 57 is affixed. The cam 57 is adapted to engage a tang 58 formed integrally on the throttle control lever 35 for positioning the throttle control lever 35 in a manner to be described.

Figure 4:
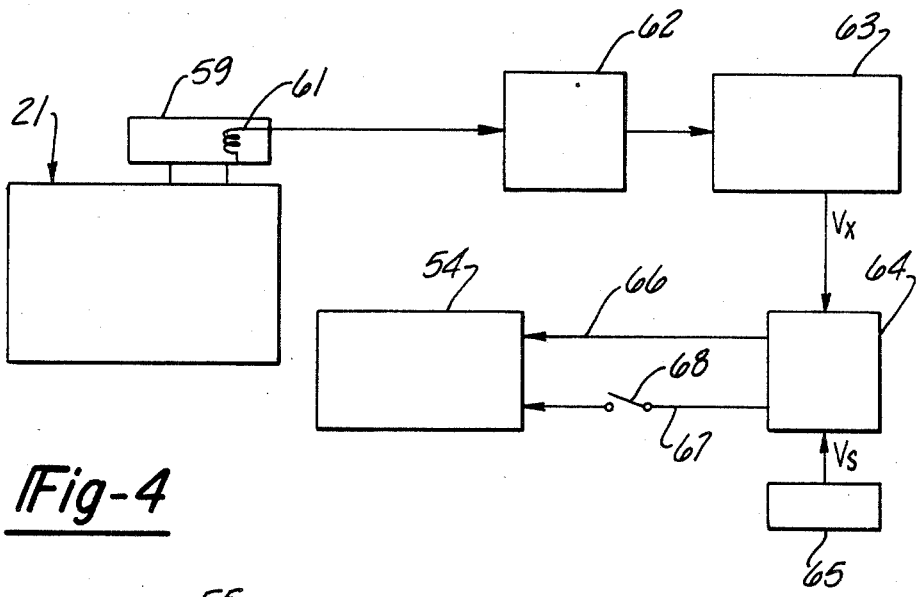
FIG. 4 is a schematic view showing the speed control mechanism.

The control circuit for the motor 54 is shown schematically in FIG. 4 and will now be described. The outboard motor 21 drives a flywheel, magneto generator, indicated generally by the reference numeral 59, and which may include the spark control mechanism. A pulser coil 61 is juxtaposed to the magneto generator 59 and is adapted to generate an output pulse in response to rotation of the flywheel 59. The number of these pulses will be indicative of the rotational speed of the crankshaft of the engine 21. The pulses from the pulser coil 61 are transmitted to a waveform shaping circuit 62 which, in turn, delivers its output to a frequency-to-voltage converter 63. The frequency-to-voltage converter 63 provides a voltage output $V_x$ that is proportional to the speed of rotation of the engine. The signal $V_x$ from the frequency to voltage converter 63 is transmitted to a comparator control device 64. The comparator portion of the device 64 also receives a preset speed signal $V_s$ in the form of a voltage from a setting device 65. The setting device 65 may be controlled either manually by the operator or may be preset so as to provide a signal $V_s$ indicative of the desired, maximum speed of the engine 21 for a given running condition. The device 64 has a pair of outlet leads 66 and 67 that extend to the motor 54 for driving it respectively in a forward, throttle closing position and reverse throttle opening position. A limit switch 68 is provided in the line 67. The limit switch 68 is mounted on the motor 21 in proximity to the cam 57 and will be engaged by the cam 57 to open the line 67 when the cam 57 is moved to an extreme throttle opening position. The switch 68 performs the function of preventing excessive rotation of the cam 57 and damage to the motor 54.

The operation of this embodiment will now be described. FIG. 1 illustrates the position taken by the various components when the engine is not running or in an idle condition. In this condition, and particularly before the engine has been started, the motor 54 will have been energized to rotate the cam 58 so that it will be clear of the tang 58 on the throttle control lever 35. The various levers 33, 35 and 43 will be held in their idle positions and the throttle valves 26, 27 and 28 will also be in their idle positions.

The desired speed, as has been noted, will be preset by the device 65 or by the operator. Preferably, the device 65 is set to a speed less than the maximum permissible speed of the engine 21 and the speed setting device may be of any known type such as a variable resistor which can be controlled by the operator. Alternatively, the device 65 may be preset and the operator may engage it at any time in a suitable manner, as by pressing a button or the like. The various ways in which the device 65 may be set and controlled are believed to be obvious to those skilled in the art and for that reason all of the various possibilities will not be described herein.

The operator may increase the speed of the engine by actuating the flexible transmitter 35 in such a direction as to rotate the throttle lever 33 in a clockwise direction. As has been previously noted, the spring 41 effects rotation of the throttle control lever 35 in the same direction by holding its pin 42 against the throttle lever 33. At the same time, the spring 45 will urge the spark control lever 43 also in a clockwise direction with its pin 44 in engagement with the throttle control lever 35.

Figure 3:
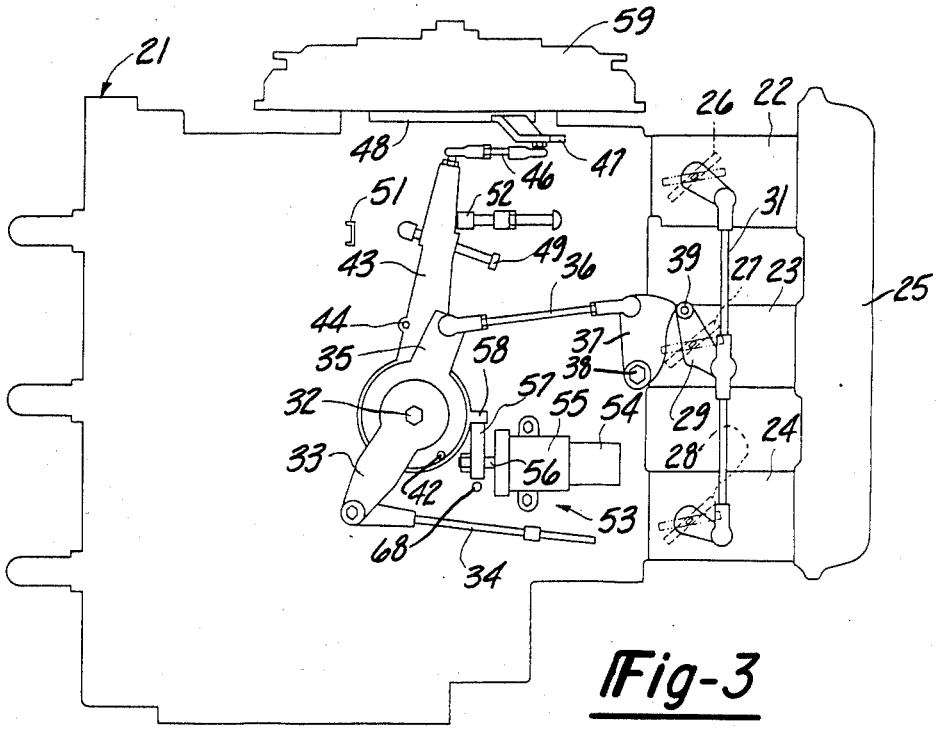
FIG. 3 is a side elevational view, in part similar to FIG. 1, showing the engine in a cruise condition.
Figure 5:
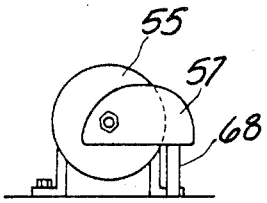
FIG. 5 is a cross-sectional view taken along the line 5—5 of FIG. 1.

Assuming now that the operator has rotated the throttle lever 35 to his desired cruise condition and the speed control has been energized, the comparator 64 will compare the actual speed of the engine 21 with the desired speed as represented by the signals $V_x$ and $V_s$. If the speed is less than the desired speed $V_x$ $V_s$, the comparator 64 will send a signal through the reverse control line 67 so as to drive the motor 54 in a direction to turn the cam 57 in a clockwise direction as shown in FIG. 5. This rotation will cause the throttle control lever 35 to rotate in a clockwise direction as shown in FIG. 3 so as to further open the throttle valves 26, 27 and 28. This movement is permitted up until the pin 42 contacts the lever 33. If for some reason the engine speed does not reach the speed desired, that is, the signal $V_x$ does not reach the signal $V_s$, the cam 57 will rotate sufficiently so as to engage and open the switch 68 and prevent further rotation of the motor 54 and the cam 57. This prevents damage and malfunction.

If the speed of the motor 21 exceeds the preset speed, the signal $V_x$ will exceed the signal $V_s$ and the comparator 64 will energize the motor 54 through the forward, speed reducing control line 66 so as to rotate the cam 57 in a counterclockwise direction. This will cause the throttle control lever 35 to be rotated in a throttle closing direction until the speed signal $V_x$ again reaches the desired speed $V_s$ at which time the comparator 64 will discontinue rotation of the motor 54.

Figure 6:
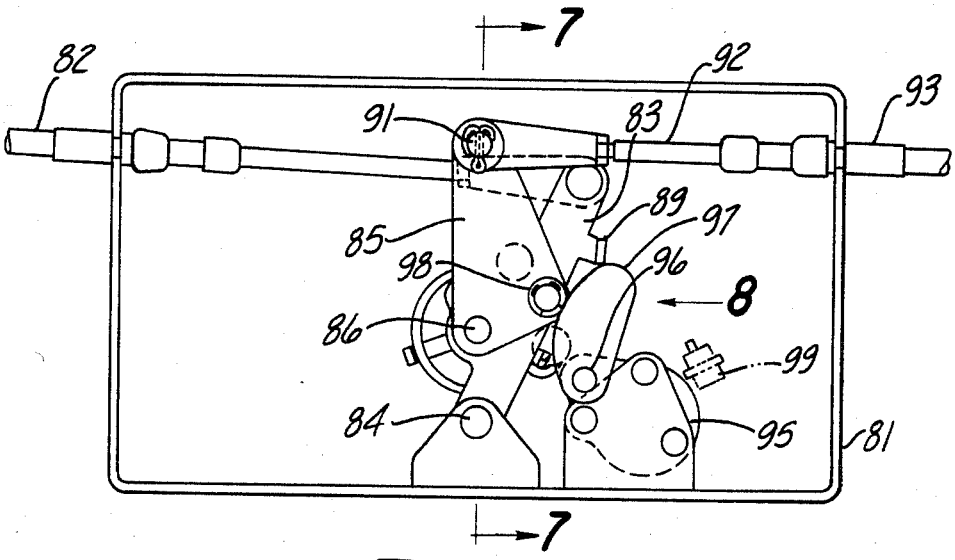
FIG. 6 is a side elevational view, with portions broken away, of a remote throttle actuator for a marine drive constructed in accordance with another embodiment of the invention.
Figure 7:
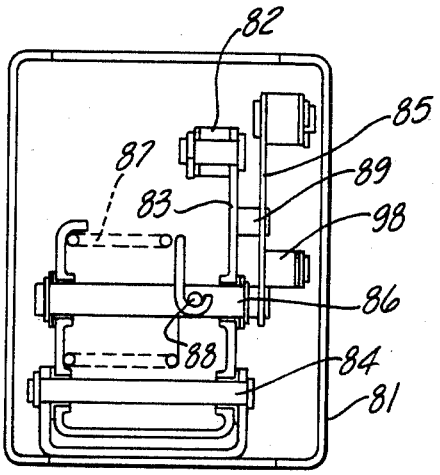
FIG. 7 is a cross-sectional view taken along the line 7—7 of FIG. 6.
Figure 8:
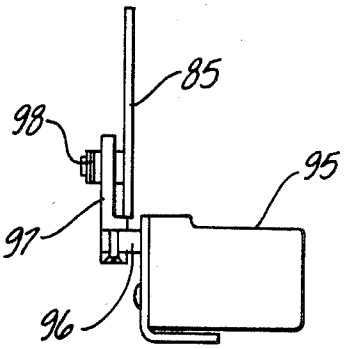
FIG. 8 is an elevational view taken in the direction of the arrow 8 in FIG. 6.
Figure 9:
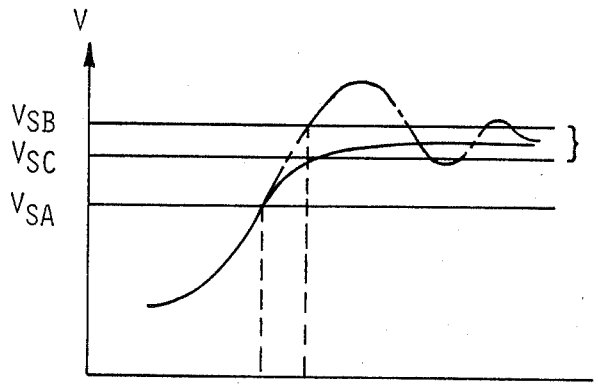
FIG. 9 is a graphical analysis showing the performance curve of a control system constructed in accordance with a further embodiment of the invention as compared to the control system employed in the embodiments of FIGS. 1 through 8.

Embodiment of FIGS. 6 Through 8

In the embodiment of FIGS. 1 through 5, the throttle control mechanism was mounted directly upon the engine. FIGS. 6 through 8 show an embodiment wherein the speed control may be positioned in a remote controller housing rather than directly upon the engine. Referring now in detail to this embodiment, a control housing 81 is provided that is mounted at a suitable location in the water craft and which is remote from the engine. An operator controlled flexible transmitter 82 is provided which is controlled by a throttle lever or the like positioned in proximity to the operator. The transmitter 82 extends into the control housing 81 and is suitably connected to a throttle lever 83 that is journalled on a pivot pin 84 in the housing 81.

A throttle control lever 85 is affixed to a pivot pin 86 which is, in turn, journalled in the throttle lever 83. A torsional spring 87 encircles the pivot pin 86 and has its one end affixed to the throttle lever 83 and its opposite end in engagement with a pin 88 that is staked to the pivot pin 86. The spring 87 normally urges the throttle control lever 85 into engagement with a tang 89 formed on the throttle lever 83 so that the levers 83 and 85 will be pivoted together about the pivot pin 84.

The throttle control lever 85 is connected by means of a pivot pin 91 to a flexible transmitter 92 which is, in turn, slidable in a protective sheath 93 and affixed at its opposite end to a suitable engine throttle control. Hence, rotation of the throttle lever 83 and corresponding rotation of the throttle control lever 85 about the pivot pin 84 will cause movement of the wire transmitter 92 so as to effect either opening or closing of the throttle valves of the associated engine as indicated by the direction of the arrows 94.

In this embodiment, the speed control includes a combined motor, gear reduction unit 95 that is supported within the housing 81 in a suitable manner. The motor, gear reduction unit 95 is controlled by a circuit such as that schematically illustrated in FIG. 4 of the preceding embodiment. Since this control is substantially the same, it will not be described again in detail.

The motor speed reducer 95 has an output shaft 96 to which a cam 97 is affixed. The cam 97 is adapted to engage a roller follower 98 that is carried by the throttle control lever 85. A protecting switch 99 is carried in the controller housing 81 and is adapted to be engaged by the cam 97 so as to limit the degree of its movement in the throttle opening position, as with the embodiment of FIGS. 1 through 5.

The embodiment of FIGS. 6 through 8 operates generally similarly to the previously described embodiment. When the operator moves the transmitter 82 to move the throttle control 93 in an opening direction, and the actual speed of the engine exceeds the predetermined maximum speed, the motor unit 95 will be energized so as to rotate the shaft 96 and cam 97 in a counterclockwise direction as shown in FIG. 6. This rotation will cause the cam 98 to engage the roller follower 98 and pivot the throttle control lever 85 in a counterclockwise direction relative to the throttle lever 83. Hence, the flexible transmitter 92 will be moved in the throttle closing direction until the speed of the engine decreases to the preset maximum speed.

If the speed of the engine is less than the desired speed, the motor 95 will be energized so as to drive the cam 97 in a clockwise direction and cause the follower 97 to follow this cam, under the action of the spring 87 and pivot the throttle control lever 85 in the throttle opening position. In the event the cam 97 engages the switch 99, the throttle advancing movement of the motor 95 will be discontinued as with the previously described embodiment for the same reasons.

Embodiment of FIGS. 9 Through 13

In the previously described embodiments, any time the speed of the engine deviated from the preset speed, the motor of the speed control device would be actuated so as to either increase or decrease the engine speed control. Although such an arrangement is extremely effective, it may provide some hunting in the running speed of the engine and also can result in some undesirable running characteristics under acceleration. This characteristic may be best understood by reference to FIG. 9 wherein engine speed V is indicated on the abscissa and time T is indicated on ordinate. The dot-dash line represents the performance characteristics of the control circuit as shown in FIG. 4. It should be noted that the engine speed will continue to accelerate upon throttle opening until the preset desired speed $V_{sb}$ is reached. At that time, the control circuit of FIG. 4 will tend to cause closing movement of the throttle valves so as to decrease the engine speed. However, the actual engine speed will continue to increase for a period of time until the motor has appropriately positioned the cam. However, because of the time delay in the system, the actual engine speed will continue to fall below the preset speed $V_{sb}$ and the motor will again be energized so as to cause throttle opening. The degree of this hunting will be gradually reduced until the preset speed $V_{sb}$ is reached.

In accordance with this embodiment of the invention, the control circuit has a range of preset speeds that include the optimum preset speed. This range is indicated by a maximum limit $V_{sb}$ and a minimum speed $V_{sc}$. In addition, a threshold speed $V_{sa}$ which is lower than the minimum desired speed $V_{sc}$ is also incorporated into the system. The performance of this embodiment is indicated by the solid line curve in this figure. It will be noted that the speed continues to increase upon acceleration until the threshold speed $V_{sa}$ is reached. In accordance with this embodiment, the throttle control mechanism is actuated for a predetermined time interval at this time so as to retard the degree of throttle opening. Hence, when the preset minimum speed $V_{sa}$ is reached, the throttle will have been positioned so as to prevent overspeeding of the engine and eliminate hunting.

Figure 10:
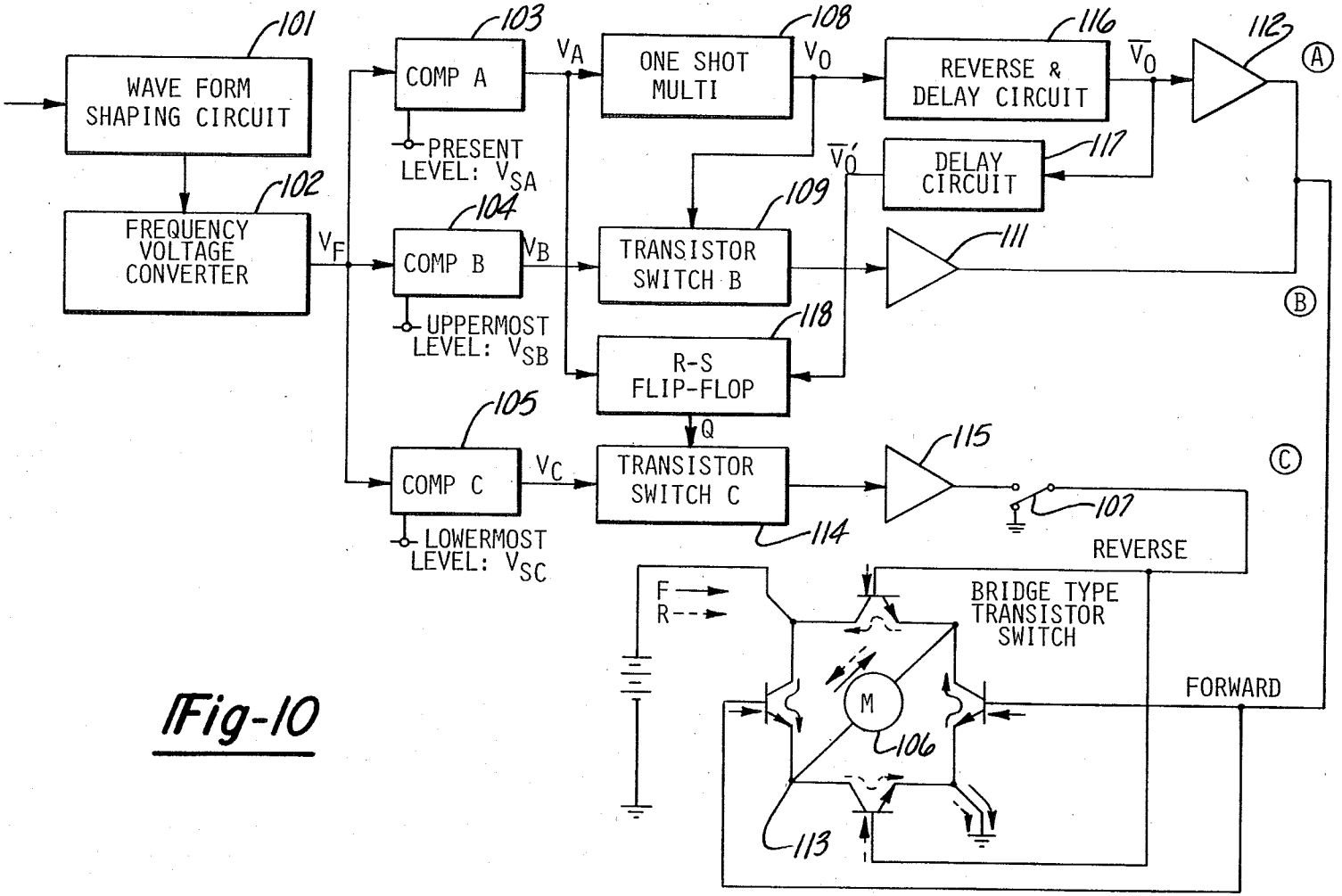
FIG. 10 is a schematic diagram showing the control system of this embodiment.

The circuit of this embodiment is shown schmatically in FIG. 10. In this embodiment, only the control circuit is described and the mechanical components and their association with the engine and/or its comparator with the throttle control mechanism may be of the type shown in the embodiment of FIGS. 1 through 5 or in the embodiment of FIGS. 6 through 8. In addition, this circuit may be used with other types of speed control devices.

The pulser coil, which is not shown, delivers its output to a waveform shaping circuit 101 which, in turn, outputs to a frequency-to-voltage converter 102. The frequency-to-voltage converter 102 gives an output signal $V_f$ which is indicative of the speed of running of the engine. The output from the frequency-to-voltage converter 102 is delivered to three comparators, each of which has a respective preset value. The first of these comparators 103 has a preset minimum threshold engine speed level $V_{sa}$. The second comparator 104 has a preset maximum desired speed level $V_{sb}$. The third compartor 105 has a preset minimum speed $V_{sc}$. The optimum engine speed lies between the speeds set by the comparators 104 and 105. That is, its speed is between the speeds represented by the levels $V_{sc}$ and $V_{sb}$. The minimum threshold speed represented by the signal $V_{sa}$ of the comparator 103 is less than the speed represented by the signal $V_{sc}$ of the comparator 105.

The comparator 103 provides an output signal $V_a$ when the actual engine speed $V_f$ exceeds the preset level $V_{sa}$ of this comparator. The signal $V_a$ is processed, in a manner to be described, and is operative to drive a motor 106 of the speed control mechanism in a forward, speed reducing direction as indicated by the solid line arrows in this figure. The motor 106 corresponds to the motor 54 of the embodiment of FIGS. 1 through 5 or the motor 95 of the embodiment of FIGS. 6 through 8.

The comparator 104 also compares the engine speed signal $V_f$ with its preset level $V_{sb}$ and puts out a signal $V_b$ when the actual speed exceeds the preset speed of this comparator. The signal $V_b$ is also processed and can be operative to drive the motor 106 in a forward direction, as will become apparent.

The comparator 105 compares the actual engine speed signal $V_f$ with its preset value $V_{sc}$ and puts out a signal $V_c$ when the engine speed is below this preset value. The signal $V_c$ is operative through a circuit, to be described, so as to drive the motor 106 in a reverse speed advancing direction as indicated by the broken line arrows in this figure. As with the previously described embodiments, a switch 107 is provided in this circuit which will be opened in the event the motor 106 is driven in a speed advancing direction greater than a predetermined amount.

The output signal from the comparator 103 $V_a$ is transmitted to a one-shot multivibrator 108 which, in turn, provides an output pulse $V_o$ for a predetermined time. By using the one-shot multivibrator 108 to provide an output of predetermined time rather than a continuous output, the effects of hunting and specifically overshooting correction may be avoided. The one-shot multivibrator output $V_o$ is transmitted to the gate of a transistor 109 that is in the circuit from the comparator 104 so that the transistor will not be conductive. The transistor 109 prevents the signal $V_b$ from being transmitted to the motor 106 at the time when the signal $V_o$ is being outputted. Hence, no output will be delivered during this time to an amplifier 111 in the circuit containing the comparator 104 and the transistor 109 for amplifying the comparator output $V_b$. A similar amplifier 112 is provided in the circuit with the one-shot multivibrator 108.

The circuit for controlling the operation of the motor 108 includes a series bridge of transistors, indicated generally by the reference numeral 113. In order to prevent damage to this circuit 113 and/or the motor 106, a further transistor 114 is provided in the output circuit from the comparator 105 to prevent its transmitting a signal to an amplifier 115 of this circuit at such a time as when the one-shot multivibrator 108 is providing an output signal $V_o$. The operation of this transistor 114 and its control will be described in connection with the description of the protective circuit.

The protection circuit which includes the transistors 109 and 114 also includes a reverse and delay circuit 116 that processes the output signal $V_o$ of the one-shot multivibrator 108. The circuit 106 delays the timing of the output signal from the one-shot 108 and reverses it so as to provide a position output signal $\overline{V}_o$. It is this signal $\overline{V}_o$ which is delivered to the amplifier 112. This signal is also transmitted to a further delay circuit 117 which provides a delayed output signal $\overline{V}_o'$ that is delivered to a R-S flip-flop circuit 118. The flip-flop circuit 118 also receives the signal $V_a$ from the comparator 103. The flip-flop circuit 108 is such that it will set when it gets the delay circuit output signal $\overline{V}_o'$ and resets when it receives the comparator output signal $V_a$. The flip-flop circuit provides an output signal Q that is operative to control the transistor switch 114 so as to render this transistor 114 non-conductive when the flip-flop output Q is delivered to it.

Figure 12:
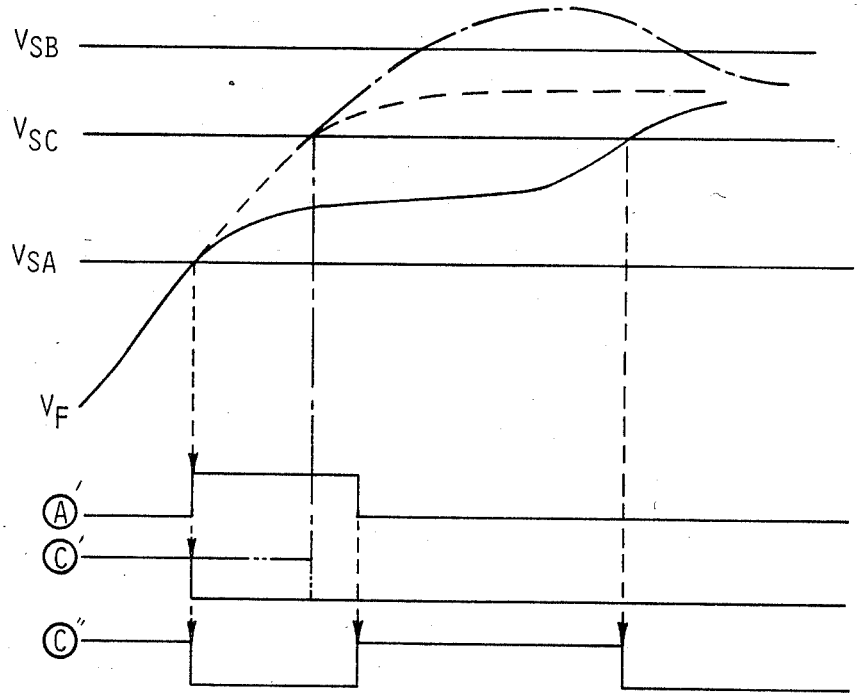
FIG. 12 is a graphical representation showing the functioning of components of the system of this embodiment.

FIG. 12 is a speed time curve showing the effect of the protection circuit. In this figure, the dot-dash curve corresponds to the dot-dash curve of FIG. 9 and represents the speed time curve for a device embodying the control circuit of FIG. 4. The broken line curve shows the operation of the device constructed in accordance with this embodiment and the solid line curve represents the operation of a device having a circuit like that shown in FIG. 10 but without the protection circuit.

The lower portion of this figure shows the output signals from the respective comparators 103 (A') and 105 (C''). As will be noted from the solid line curve, the speed increases until the threshold speed $V_{sa}$ is reached. When this occurs, the comparator 103 will provide an output signal (A') to operate the motor 106 in the forward, throttle closing direction. This signal is transmitted for a period of time set by the one-shot multivibrator 108. Immediately upon termination of the signal from the one-shot 108, the comparator 105 will provide an output signal $V_c$ indicating that the speed of the engine is below the minimum desired speed $V_{sc}$ and it will provide an output signal C''. However, the transistor bridge cannot turn off immediately and operates with a time delay of about 10 milliseconds. Thus, all transistors will be held on for a period of approximately 10 milliseconds and damage could occur to the motor 106 and its bridge transistor circuit 113.

Figure 2:
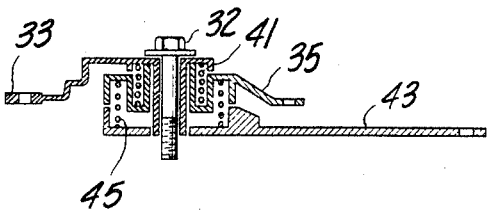
FIG. 2 is an enlarged cross-sectional view taken along the line 2—2 of FIG. 1.
Figure 13:
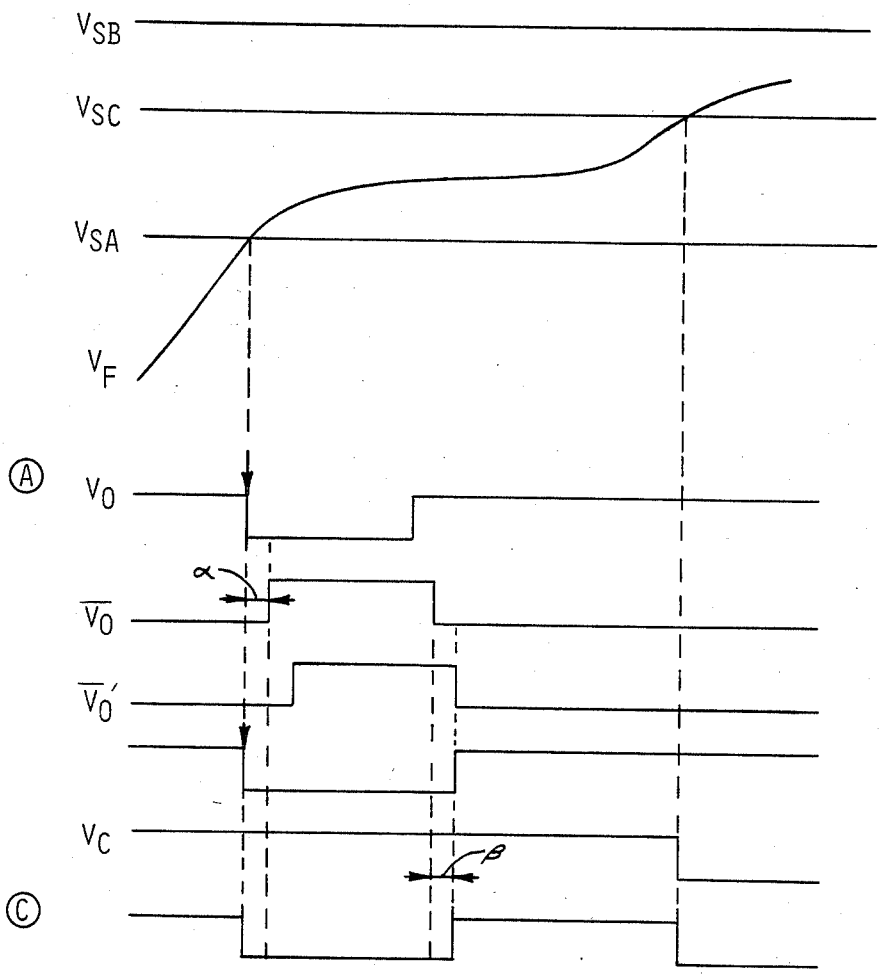
FIG. 13 is a graphical representation, in part similar to FIG. 12, further explaining the operation of this embodiment.

FIG. 13 is a curve similar to FIG. 2 but shows the operation of the time delay and protection circuit. As the velocity $V_f$ increases and exceeds the minimum threshold velocity $V_{sa}$, the comparator 103 will provide an output signal $V_a$. This will cause the flip-flop circuit 108 to reset and cause the transistor 114 to become non-conductive. The one-shot multivibrator 108 will provide an output signal $V_o$. The output signal $V_o$ is delivered to the reverse and delay circuit 116 which, with a time delay $\alpha$ provides its output signal $\overline{V}_o$. This output signal is transmitted through the amplifier 112 to operate the motor 106 in a forward direction. At the same time the output signal $\overline{V}_o$ is transmitted to the delay circuit 117 to provide a further delayed signal $\overline{V}'_o$ to the flip-flop circuit 118. There will be no change in the output of this circuit 118 at this time, however. When the delay $\beta$ of the circuit 117 has expired, the signal $V'_o$ will be discontinued and the flip-flop circuit 118 will output the signal Q to render the transistor 114 conductive. If the velocity $V_f$ of the engine is below that of the level $V_{sc}$ of the comparator 105, the comparator 105 will provide its output signal $V_c$ through the now conductive transistor 114 to its amplifier 115 so as to drive the motor 106 in the reverse, throttle opening direction. This signal will continue to be transmitted until the velocity $V_{sc}$ is exceeded by the engine speed $V_f$ and the comparator 105 no longer provides its output signal $V_c$.

Figure 11:
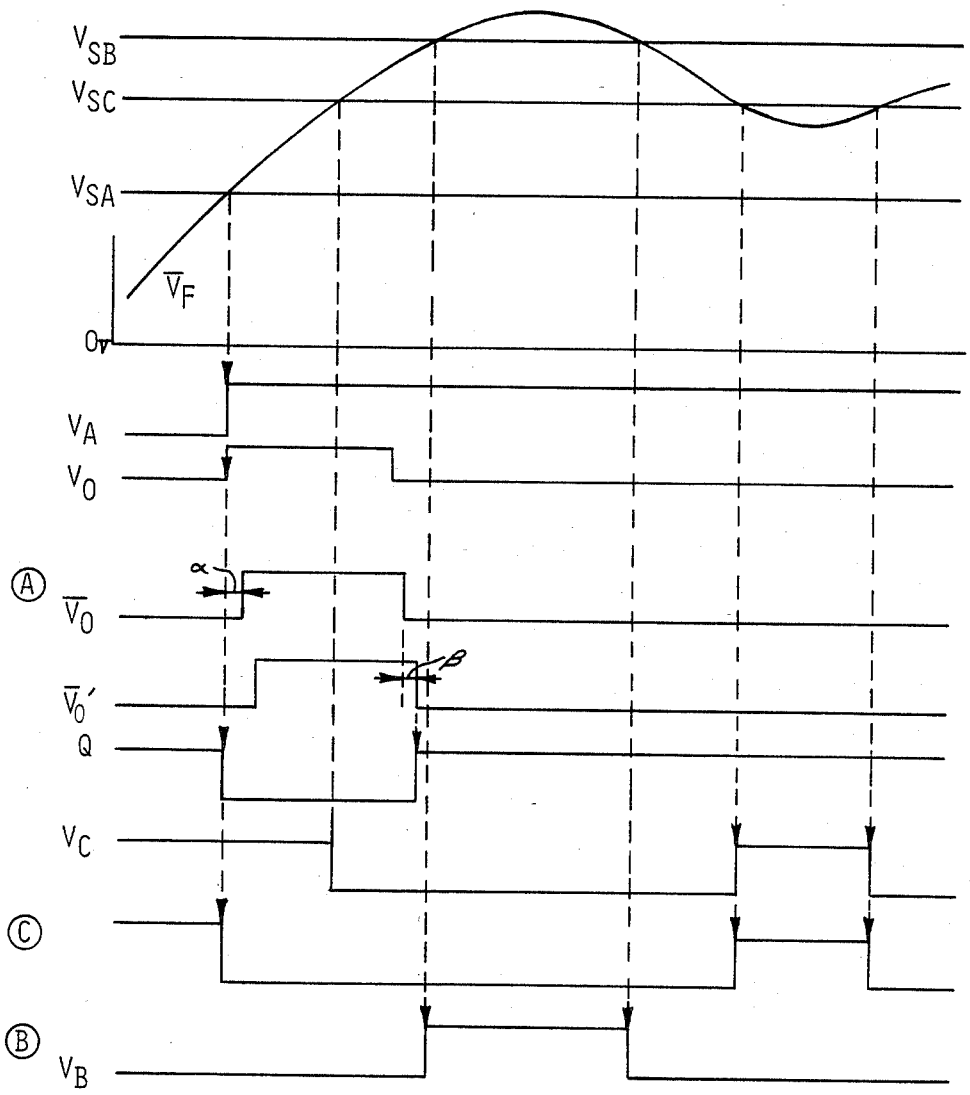
FIG. 11 is a schematic diagram showing the sequencing of operation of this embodiment.

The operation of the embodiment of FIG. 10 will now be described by particular reference to FIG. 11 wherein a cycle of operation during a given speed time curve appears. Beginning at the left of this curve, the actual engine speed $V_f$ will increase and when the lower threshold $V_{sa}$ is exceeded, the comparator 103 will provide its output signal $V_a$ to the one-shot multivibrator 108. The signal $V_a$ will also be transmitted to the flip-flop circuit 118 so as to reset it and discontinue the signal Q so as to turn the transistor 114 off. The one-shot multivibrator 108 provides its output signal $V_o$ for a given time period which is, in turn, transmitted to the reverse and delay circuit 116. The output signal $V_o$ also switches the transistor switch 109 off at this time.

The output of the reverse and delay circuit 116 ($\overline{V}'_o$) is amplified by the amplifier 112 and operates the motor 106 through its transistor bridge circuit 113 in the forward, throttle closing direction after the time delay $\alpha$. The throttle will then be moved toward a closing direction. It is assumed that the actual engine speed $V_f$ exceeds the minimum desired speed $V_{sc}$ at this time. When the minimum engine speed $V_{sc}$ is exceeded, the comparator 105 will no longer transmit an output signal $V_c$.

After the time delay $\beta$ of the delay circuit 117, the signal $\overline{V}'_o$ will be discontinued and the flip-flop circuit 118 will be set so that the transistor 114 is again turned on.

Assuming that the engine speed $V_f$ continues to rise and now exceeds the maximum level $V_{sb}$, the comparator 104 will give its output signal $V_b$. Since the signal $V_o$ is no longer present, the transistor 109 will be on and the amplifier 111 will provide an output that drives the motor 106 in the forward, throttle closing position. This continues until the engine speed $V_f$ falls below the $V_{sb}$. The comparator 104 then will cease to provide an output signal to drive the motor 106 in the throttle closing position.

If now the engine speed falls below the minimum desired engine speed $V_{sc}$, the comparator 105 will provide its output signal $V_c$ through the conductive transistor 114 to the amplifier 115. The motor 106 will then be driven in a reverse, throttle opening position until the speed rises above the line $V_{sc}$ and then the comparator 105 will discontinue its output signal and the engine speed will be stabilized.

It should be noted that the transistor switch 109 is used so as to prevent both the comparators 103 and 104 from transmitting signals through their respective amplifiers to the motor control circuit 106. Although the respective output voltages of the amplifiers 112 and 113 should be the same, they may be slightly different from each other and the transmission of unequal and simultaneous signals to the motor control circuit 113 could cause it to be damaged. The switch 109 could be deleted, however, if diodes were placed in the output circuits of the amplifiers 111 and 112.

It should be readily apparent from the foregoing description that several embodiments of the invention have been described, each of which provides extremely good speed control. In addition, a control circuit has been described that effectively prevents hunting and insures long life as well as maintaining good engine speed control. Although three embodiments of the invention have been illustrated and described, it is to be understood that various changes and modifications may be made, without departing from the spirit and scope of the invention as defined by the appended claims.

We claim:

1. In a speed control mechanism for an internal combustion engine having an engine speed control for controlling the operational speed of the engine and movable through a range of positions, an operator controlled speed selector movable through a range of positions and means for interrelating said speed selector and said engine speed control for positioning said engine speed control in response to an operator input to said speed selector for setting the running speed of said engine, the improvement comprising said interrelating means including means for permitting said engine speed control to move independently of said speed selector, means for measuring the actual speed of said engine and means for moving said engine speed control independently of said speed selector for varying the actual running speed of the engine if the measured speed is not of a predetermined value, said means for moving said engine speed control being effective to move said engine speed control in a speed reducing direction if the measured engine speed is above a preset maximum desired engine speed and is effective to move the engine speed control in a speed increasing direction if the measured engine speed is below a preset minimum desired engine speed, said preset minimum and maximum desired engine speeds defining a range that includes the predetermined value.

2. In a speed control mechanism as set forth in claim 1 further including means for selectively setting the predetermined speed independently of said operator controlled speed selector.

3. In a speed control mechanism as set forth in claim 1 wherein the means for moving the speed control includes comparator means for comparing a signal from the measuring means with the predetermined speed value.

4. In a speed control mechanism as set forth in claim 1 wherein the means for permitting the engine speed control to move independently of the speed selector comprises a lost motion connection.

5. In a speed control mechanism as set forth in claim 4 wherein the speed control is mounted on the engine.

6. In a speed control mechanism as set forth in claim 5 wherein the engine speed control comprises a throttle control lever rotatably journalled on the engine and the operator speed selector comprises a throttle lever rotatably mounted on the engine about the same axis as the throttle control, and further including biasing means for normally effecting common rotation of said throttle control lever and said throttle lever.

7. In a speed control mechanism as set forth in claim 4 wherein the speed control mechanism is positioned remotely from the engine.

8. In a speed control mechanism as set forth in claim 7 wherein the engine speed control comprises a throttle control lever pivotally supported remotely from the engine and the operator controlled speed selector comprises a throttle lever pivotally supported remotely from the engine.

9. In a speed control mechanism as set forth in claim 8 wherein the throttle control lever is pivotally supported on the throttle lever.

10. In a speed control mechanism as set forth in claim 1 further including means for limiting the degree of movement of the engine speed control relative to the speed selector in one direction.

11. In a speed control mechanism as set forth in claim 10 wherein the means for limiting the degree of relative movement is effective in the throttle opening direction.

12. In a speed control mechanism as set forth in claim 1 further including means for moving the engine speed control in a speed reducing direction if the measured engine speed is below a preset minimum threshold speed which minimum threshold speed is less than the preset minimum desired speed.

13. In a speed control mechanism as set forth in claim 12 wherein the means for moving the throttle control in the speed reducing direction is operative for a predetermined time period.

14. In a speed control mechanism as set forth in claim 13 wherein the means for moving the throttle control in a speed reducing direction comprises first comparator means for comparing the actual engine speed with a preset maximum desired engine speed, the means for moving the throttle control in a speed increasing direction when the speed is below the preset minimum speed comprises a second comparator means for comparing the actual engine speed with the preset minimum speed and the means for moving the throttle control in a speed reducing direction when the measured engine speed is below the preset threshold speed comprises a third comparator for comparing the measured engine speed with the preset threshold speed and a one-shot multivibrator for providing an output signal for a predetermined time period.

15. A speed control mechanism as set forth in claim 1 wherein the means for moving the engine speed control in a speed reducing direction comprises first comparator means for comparing the actual engine speed with a preset maximum desired engine speed, the means for moving the engine speed control in a speed increasing direction when the speed is below the preset minimum speed comprises a second comparator means for comparing the actual engine speed with the preset minimum speed and the means for moving the engine speed control in a speed increasing direction when the measured engine speed is below the preset threshold speed comprises a third comparator for comparing the measured engine speed with the preset threshold speed and a one-shot multivibrator for providing an output signal for a predetermined time period.

16. A speed control mechanism as set forth in claim 1 further including means for controlling the ignition timing of the engine, and means for mechanically coupling said engine timing control means to said engine speed control for varying the engine timing in response to positioning of the engine speed control.

* * * * *